US005882240A

United States Patent [19]

Larsen

[11] Patent Number: 5,882,240

[45] Date of Patent: Mar. 16, 1999

[54] TOY BLIMP

[76] Inventor: Bradley B. Larsen, 2702 Queen Anne Ave. N., Seattle, Wash. 98109

[21] Appl. No.: 701,885

[22] Filed: Aug. 23, 1996

Related U.S. Application Data

[60] Provisional application No. 60/002,805 Aug. 25, 1995.

[51] Int. Cl. [6] ..... A63H 3/06

[52] U.S. Cl. ..... 446/225; 446/222; 446/59

[58] Field of Search ..... 446/57, 59, 60, 446/220, 222, 225, 459

[56] References Cited

U.S. PATENT DOCUMENTS

| | | | |
|---|---|---|---|
| 787,515 | 4/1905 | Hunter | 446/225 |
| 1,765,435 | 6/1930 | McBride | 446/225 |
| 2,351,504 | 6/1944 | Guillow | 446/68 X |
| 2,543,516 | 2/1951 | Walker | 446/59 |
| 3,225,488 | 12/1965 | Goldfarb | 446/225 X |
| 4,752,271 | 6/1988 | Reilly et al. | 446/225 |
| 4,891,029 | 1/1990 | Hutchinson | 446/225 X |
| 4,946,415 | 8/1990 | Huang | 446/225 |
| 5,343,889 | 9/1994 | Jaw | 446/222 X |
| 5,496,203 | 3/1996 | Murray | 446/222 |

FOREIGN PATENT DOCUMENTS

| | | | |
|---|---|---|---|
| 936695 | 11/1973 | Canada | 446/459 |
| 643205 | 9/1950 | European Pat. Off. | 446/68 |

*Primary Examiner*—Robert A. Hafer
*Assistant Examiner*—D Neal Muir
*Attorney, Agent, or Firm*—Christenson, O'Connor

[57] ABSTRACT

A toy blimp (20) including a gas filled body (22), a plurality of fins (26), a propulsion system (28) attached to a lower surface of the body, and one or more small weight clips (80). A refill valve (30) may be located on the body surface. Various embodiments of the propulsion system are provided, including a rubberband powered system, a small wind-up spring-loaded motor, and a spool-type rubberband motor.

14 Claims, 7 Drawing Sheets

20
24
FRONT END
80
62
56
64
68
72
78
34
32
66
60
30
54
22
70
28
58
26
26
26
26
26
80
AFT END

TOY BLIMP

STATEMENT OF RELATED APPLICATIONS

This application claims the benefit of U.S. Provisional Application No. 60/002,805, filed Aug. 25, 1995.

FIELD OF THE INVENTION

The present invention relates to airships, and more particularly to a propelled toy blimp.

BACKGROUND OF THE INVENTION

Current toy blimps, and particularly dirigibles, are relatively large and require a sizable investment of time and money to build and operate. A typical arrangement includes a gondola mounted on the underside of the blimp body; a number of propellers mounted on the gondola; a power source to attached to the gondola to rotate the propellers; and a remote control steering system.

Most designers of current toy blimps at tempt to design their crafts to be in constant equilibrium with the atmosphere. This causes significant design problems because it requires that the blimp include a control system, in part in order to bring the craft down to earth after its fuel or battery power is spent. The control system, however, adds weight that must be counterbalanced in order to encourage level flight. The end result is that these toys typically have complex and cumbersome propulsion and steering systems.

These complicated systems necessitate the use of heavier construction materials, heavy batteries or fuel, and additional structural componentry. This adds to the cost and time required to manufacture these blimps and results in most manufacturers offering only kits instead of a more desirable pre-assembled blimp that is instantly ready to be played with. Moreover, these blimps are very large, over 12 feet long. Assembled blimps are expensive.

On the opposite extreme, are floating balloons. These are very simple, but boring as a toy because they do not do anything. They have no moving parts. They are not capable of propelled flight. They simply provide visual amusement through the floating indicia printed on their outer surfaces.

These balloons are further disappointing because they do not last very long since their internal gas tends to leak out after about five days. Some balloon manufacturers claim to have refillable balloons. One method is to provide an extension on the balloon edge comprised of opposed adhesive covered surfaces that may be separated in order to add gas. These types of valves fail after three or more openings and closings, because dust and oil accumulate in the adhesive and reduce the glue's ability to adhere, and therefore retain the gas within the balloon.

Another type of supposedly refillable balloon is the type that includes an elongated extension stemming from an edge of the balloon. When the balloon loses helium, the tip of the extension is cut off, the balloon is refilled with gas, and the new extension end is heat sealed again. Eventually, the extension becomes very short and the user can no longer reseal the balloon. Another type uses the same extension, but instead requires the user to twist the extension and attach a hinged clamp around the twisted portion. The extension is usually formed from a thin material that tears after being subjected to about five openings and closings.

There exists a need for an inexpensive toy blimp capable of being easily and economically manufactured so as to reduce the amount of assembly required by the user. Such an optimal device should be truly refillable in order to extend its life, and should include a simple propulsion mechanism. The toy should be capable of being propelled to follow a general flight path, and configured so as to be stable even with only minimal controls and control surfaces.

The present invention provides such an optimal toy blimp. It is capable of being cheaply, easily, and quickly mass produced. It is believed to be the only known small-scale propelled blimp that actually flies with control lines attached. The present invention further includes a unique refillable valve and a sturdy propulsion system to withstand repeated use.

SUMMARY OF THE INVENTION

In accordance with aspects of the present invention, a toy blimp is provided including a gas-fillable body, a plurality of fins attached to the body exterior, a propulsion system attached to a lower surface of the body, and one or more small weight clips. A refill valve is located on the body surface.

In accordance with aspects of the invention, the body is filled with helium or a mixture of helium and breath or air. The body is preferably formed by heat-sealing together the peripheral edges of two sheets of plastic (organic polymer) to form a teardrop-shaped sealed pocket. Alternatively, it also may be formed by folding a thin sheet of material having a heat-sensitive adhesive side in accordion fashion. This method results in a multi-paneled body. The sheet is then heat-sealed along a predetermined line to form the body. In either case, an opening is provided in the body or pocket and is used to inflate the body with gas. The opening may be provided by attaching a valve to the body or may be formed by leaving a portion of the heat-seal line unconnected. This portion is thereby open, allowing the body to be inflated with gas. The opening is closed after the body is fill.

In accordance with aspects of the invention, the preferred valve is a one-way refillable valve located on the body surface. The valve includes an annular base attached to the body, a tubular nipple attached normally to the base and having a gas passage, and a cylindrical stop having one end sized to fit within the nipple; wherein the body includes a cut at the location of the base that forms a flap over the air passage.

In accordance with aspects of the invention, there are three or more spaced apart fins attached around the circumference of the body extending radially outward in a longitudinal orientation. The fins are formed of a lightweight material, e.g., extruded foam, wood, plastic, paper, etc. In an alternative design, the fins may be slightly deformable.

In accordance with an important aspect of the invention, the propulsion system is a rubberband powered system having a rubberband for turning a propeller that is supported by a shaft having forward and aft ends. The shaft extends longitudinally near the body lower portion at a preferred angle of between about 5 to 20 degrees downward at the shaft forward end. The two supports are connected to the body and to opposed ends of the shaft. The length of the shaft is approximately one-half the longitudinal length of the body, but can vary in length. Alternatively, the propulsion system may be formed to include a small wind-up spring-loaded motor or a spool-type rubberband motor.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1A:
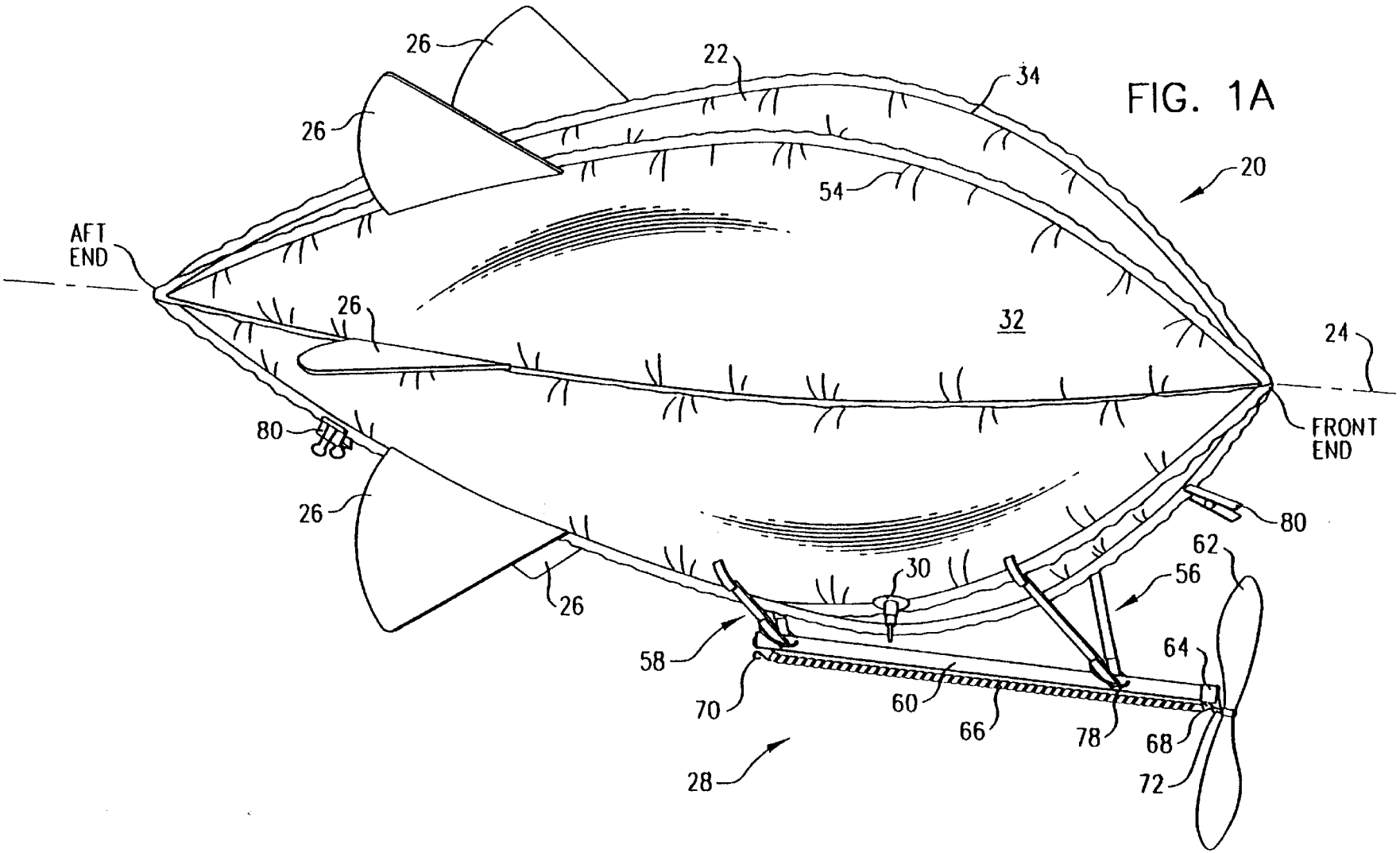
FIGS. 1A and 1B are side and front end views of a toy blimp formed in accordance with the present invention.
Figure 1B:
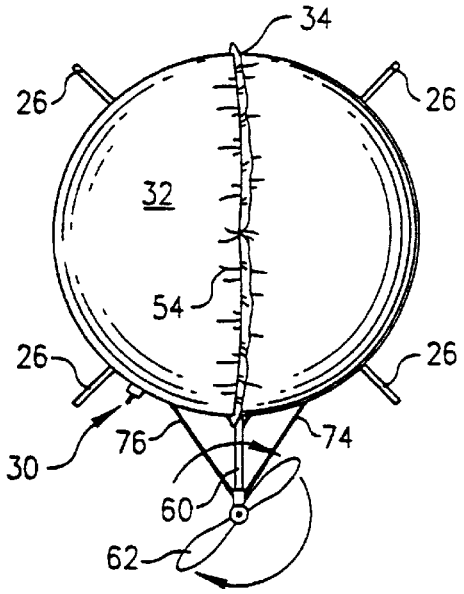

In general, a toy blimp 20 formed in accordance with the present invention includes a gas filled body 22, a plurality of fins 26, a rubberband powered propulsion system 28, and one or more small weight clips 80. The preferred embodiment further includes a refill valve 30. General views are provided in FIGS. 1–4.

Referring to FIGS. 1A, 1B, 2A, and 2B, the body 22 is an oval, or teardrop shape, such that it is longer than it is wide or tall. The toy has been found to work well when the length is between two and three feet, although successful prototypes are possible having lengths as small as one foot. The body 22 has a longitudinal axis 24 extending in a straight line from the forward-most end to the rearward-most end. The preferred body is made of multiple, ultra-thin sheets 32, joined at their edges to form a sealed, gas-fillable container. The preferred gas with which to fill the body 22 is pure helium, although other gases, such as ordinary air, may be mixed with the helium. Hydrogen may be used, but is not recommended because of its highly flammable nature.

There are a multitude of variations that may be made to the body 22. Some of these variations are illustrated in FIGS. 2A–2F. The body 22 may be transparent, opaque, or translucent. The body 22 also may include various printings or depictions 18 on its inner or outer surface, or may be completely transparent in order allow display of lightweight objects placed in its interior (e.g., confetti, origami figures, paper-mache, small balloons, etc.) The body 22 may also include virtually any lightweight, aerodynamically unobstructive item attached to its exterior surfaces (e.g., LED's, glow-in-the-dark stickers, fuzz, streamers, etc.)

FIGS. 3–8 detail aspects of preferred methods of forming the body 22. In general, the body 22 is formed of multiple sheets 32 or panels attached at their edges, one to the other.

Figure 3:
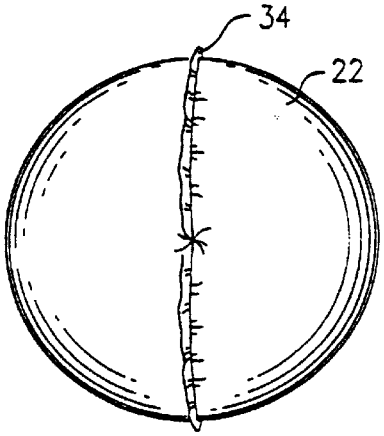
FIG. 3 is an end view of a first embodiment of a body formed in accordance with the present invention.
Figure 4A:
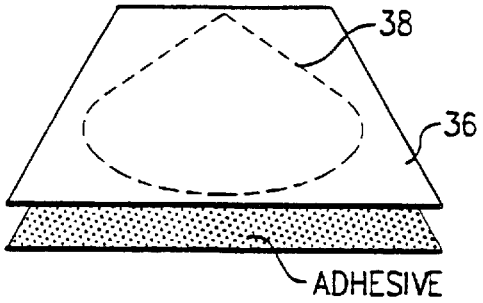
FIGS. 4A and 4B are front perspective and front elevational views of a method of manufacture for use in forming the body of FIG. 3.
Figure 4B:
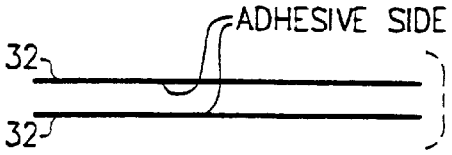

Referring to FIGS. 3, 4A, and 4B, the most cost effective method of body manufacture is to use two sheets 32, 32' of thin plastic film (e.g., mylar, biaxial nylon, etc.). This method is currently used in creating mylar balloons. Each sheet 32, 32' has a structural side 31 and a heat-sensitive adhesive side 33. The adhesive sides of the two sheets are placed next to each other, and a hot element is used to heat-seal a teardrop shaped line 38, the interior of which forms the body 22. (Alternatively, radio frequency welding, or the like, may be used to bond the thin sheets.) The edges outside the heat-sealed lines are trimmed away. The resulting seams 34, shown in FIG. 3, may be made flush with the body surface by folding them to one side.

Figure 9:
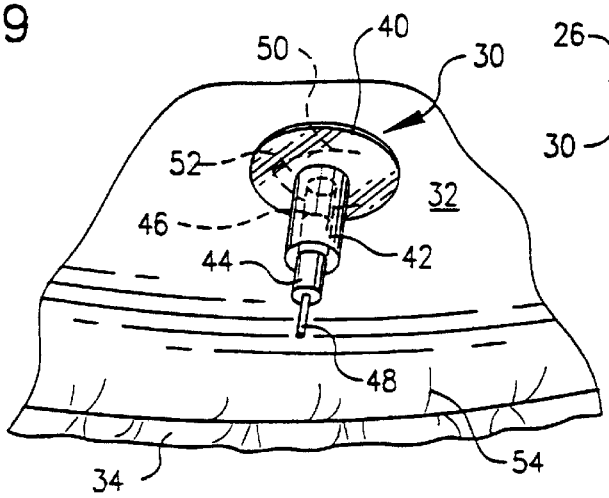
FIG. 9 is a detail perspective view of one embodiment of a refill valve formed in accordance with the present invention.

The preferred method of adding a valve is described below with reference to FIG. 9. Alternatively, a cut (see description below) may be made in both sides of the body 22, with the cut on one side being subsequently patched using strong tape. The body 22 is then filled with gas via the valve 30. If a valve is not to be included in the body 22, then a hole may be formed by omitting a portion of the heat-sealed line, the hole thereby acting as a gas fill port. Once the body 22 is fall of gas, the hole is sealed.

Figure 5:
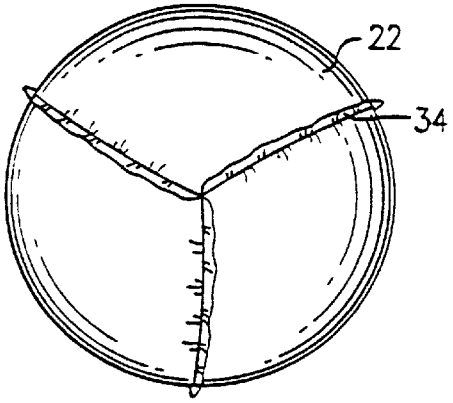
FIG. 5 is an end view of a second embodiment of a body formed in accordance with the present invention.
Figure 6A:
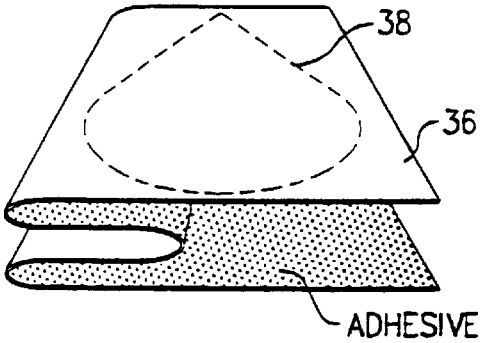
FIGS. 6A and 6B are front perspective and front elevational views of a method of manufacture for use in forming the body of FIG. 5.
Figure 6B:
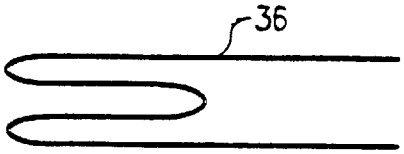

Referring to FIGS. 5, 6A and 6B, a novel method formed in accordance with the present invention is provided for forming a three panel body. According to this method, a single thin sheet 36 has a smooth structural side 31 and a heat-sensitive adhesive side 33. The single sheet 36 is folded in accordion fashion. In particular, there are three folds 35*a*, 35*b*, 35*c*. The sheet 63 is first laid flat with its adhesive side 33 up. Two thirds of the sheet are folded over the bottom third, thus forming the first fold 35*a*. The top portion is then folded back, such that the second fold 35*b* occurs approximately at the center of bottom third. The top portion is then folded back again across the second fold to form the third fold 35*c* located directly above the first fold 35*a*. The edge of the top sheet should extend roughly to the edge of the bottom portion. Shown in FIG. 6A, a hot element heat-seals the folded sheet along a dotted line 38 corresponding to the desired body panel shapes. Inflating the panels results in a three paneled body. Once the heat-seal has been made, the body is inflated using the valve, or according to the above method for non-valve embodiments.

Figure 7:
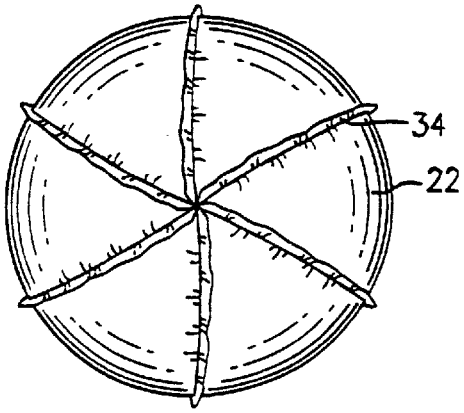
FIG. 7 is an end view of a third embodiment of a body formed in accordance with the present invention.
Figure 8A:
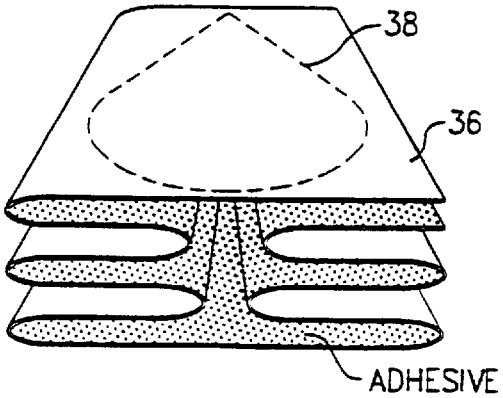
FIGS. 8A and 8B are front perspective and front elevational views of a method of manufacture for use in forming the body of FIG. 7.
Figure 8B:
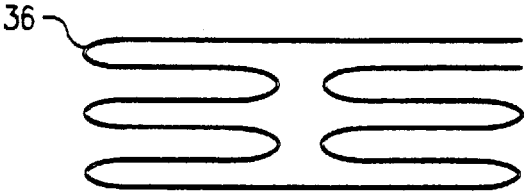

FIGS. 7, 8A and 8B show a similar method for creating a six paneled body. The above described three panel technique described above may be modified to form any number of panels. Other methods of forming the body 22 are available, although not preferred. These other methods include, for example, placing an ovalshaped line of glue between two thin sheets, manually pressing the sheets together, and trimming the excess material outside the seal. Additional methods for forming a body are using blow molding, injection molding, resin or fiberglass castings, sewn panels, metal stampings, vacuum formings, taped panels, ultrasonic welding, etc.

Referring to FIG. 1A, the refill valve 30 is located on the body 22 in a location that is preferably inconspicuous, such as on the body underside. The refill valve 30 may be any currently known valve. One example is those used on beach balls (shown in FIG. 2A) and other inflatable swimming toys. A preferred valve, shown in FIG. 9 is a one-way refillable valve having a base 40, a nipple 42, and a stop 44. The base 40 is an annular disc attached to the exterior surface of the body 22. The attachment may be of any known method, e.g., adhesion. The nipple 42 is a hollow cylinder attached at one end to the base 40 so that the hollow portion of the cylinder aligns with the central opening in the annular base 40. The other end of the nipple 42 is open. The stop 44 includes one end 46 designed to closely fit within the open end of the nipple 42 and a distal end 48 having a much, narrower diameter.

A V- or U-shaped cut 50 in the body surface at the location of the base 40, forms a flap 52 that allows gas to be blown through the nipple 42 into the body 22, but is otherwise pushed against the opening of the nipple 42 via the back pressure of the gas within the body 22. The back pressure prohibits gas from leaving the body through the opening in the nipple 42. In order for this to work properly, the cut 50 must form a flap 52 that is large enough to cover the entire opening of the nipple 42. To deflate the toy 20, the stop narrow end 48 is inserted into the nipple 42 to push the flap 52 aside and let the gas expel. Of course, other refill means may be used, or the 4 refill valve 30 may be omitted all together as discussed above.

Figure 2A:
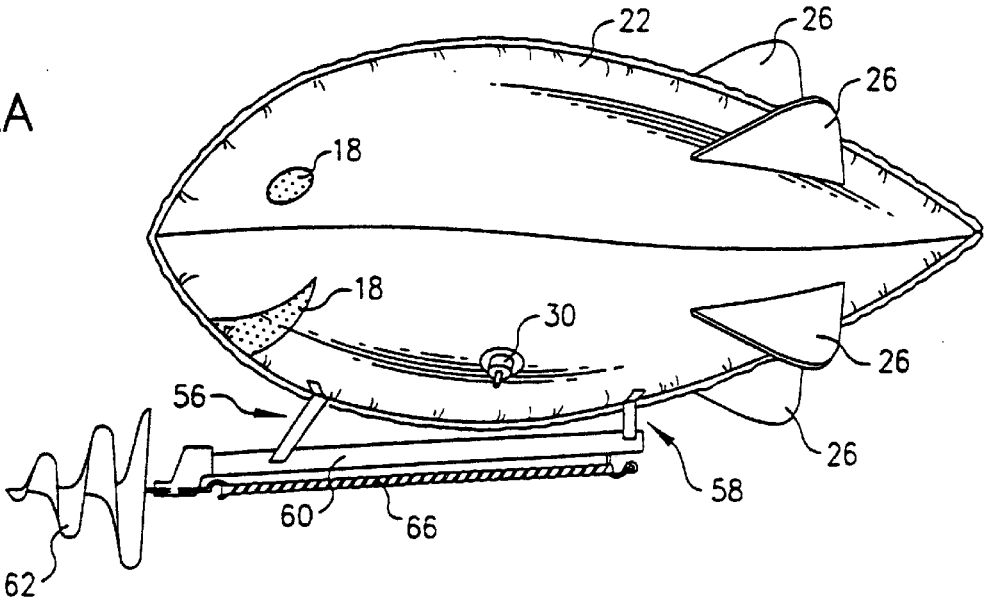
FIGS. 2A–2E and 2F are side views and a rear view of alternative embodiments of a toy blimp formed in accordance with the present invention.
Figure 2B:
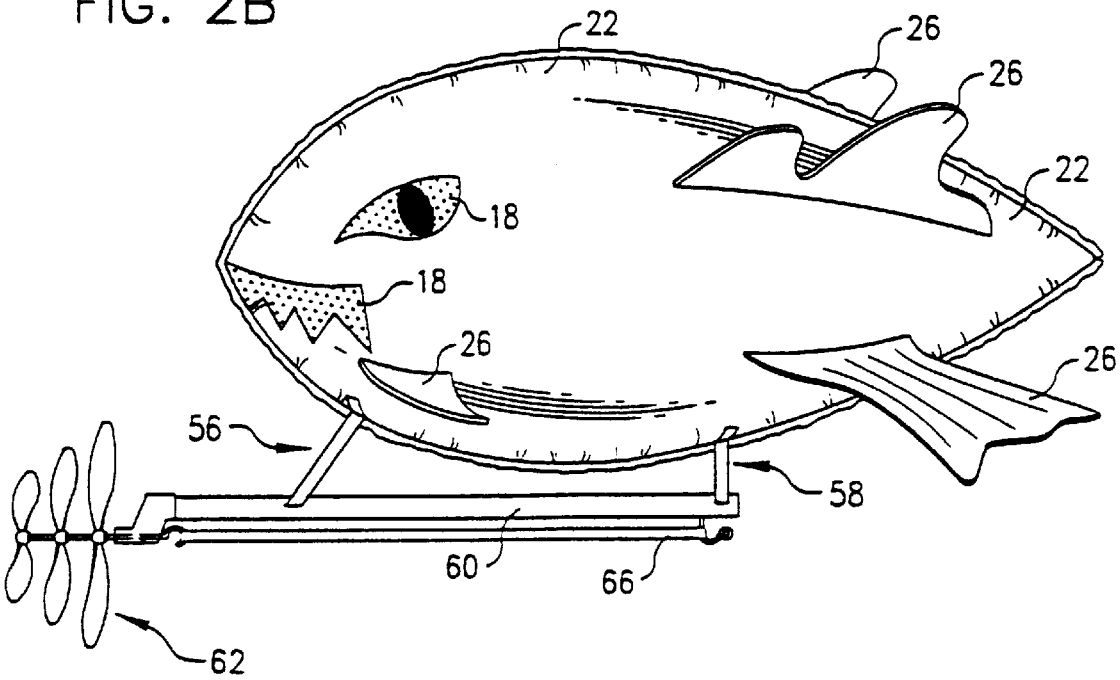
Figure 2C:
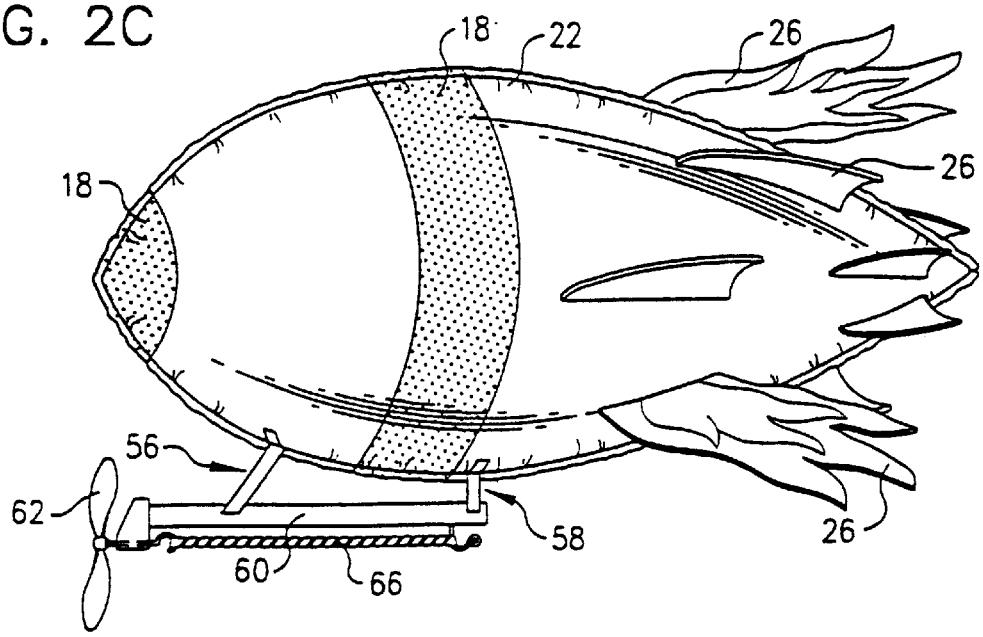
Figure 2D:
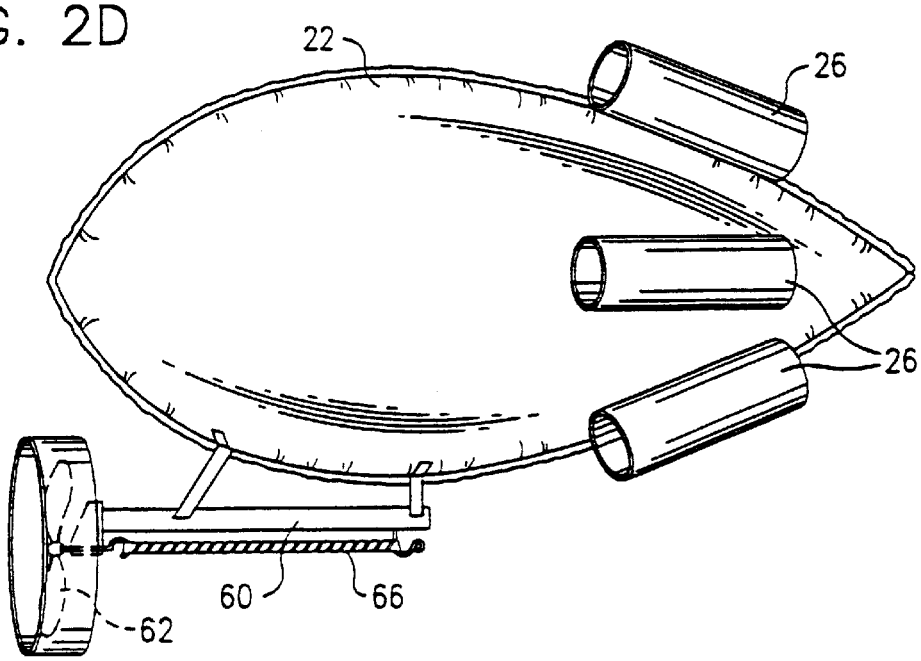

The plurality of fins 26 are attached at various external surface locations of the body 22. See FIGS. 2A–2F, for examples. The term "fins" as used herein is meant to encompass any shape that is designed to extend generally radially from the body outer surface. In the embodiment of FIG. 1A, the fins 26 are triangular in shape with one edge attached to the body 22. The fin 26 is oriented in a radial-longitudinal plane relative to the body centerline. In other embodiments, the fins 26 may be shaped similar to animal limbs, machine parts, fanciful designs, or the like. The exact shape of the fins may vary widely. Various types of fins may also be used on the same body. In addition, fins may be formed of hair or fine strands so long as they are somewhat rigid and are arranged to extend in an outward manner. As shown in FIG. 2D, the fins 26 may be formed as cylinders and arranged about the periphery of the body 22. The cylinder axes are oriented in a longitudinal manner.

Figure 2E:
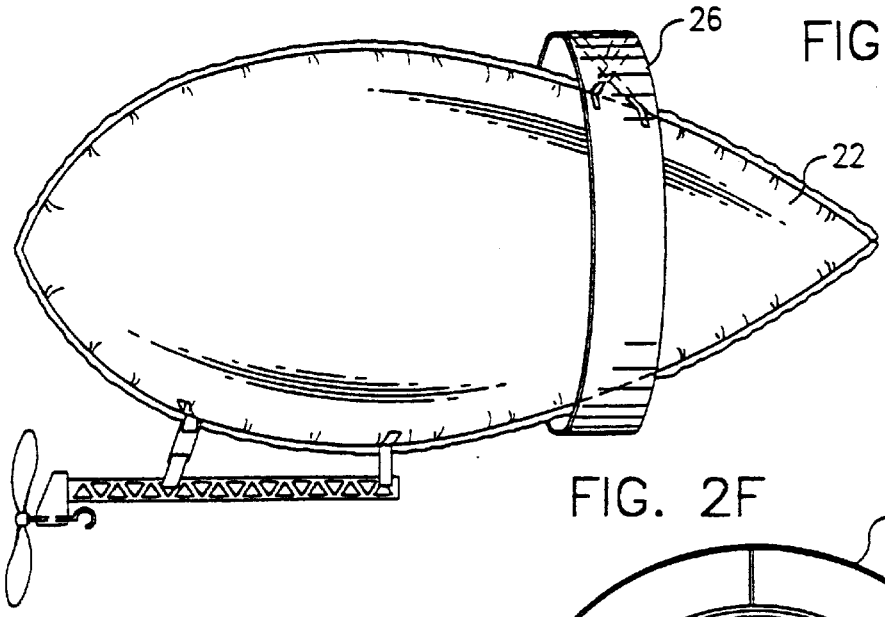
Figure 2F:
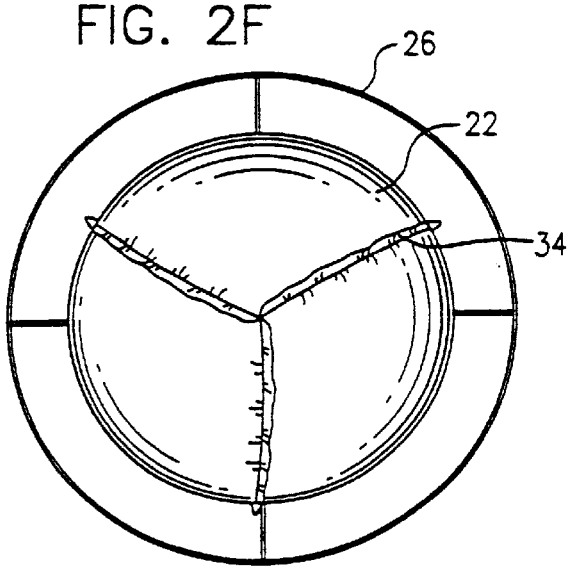
Figure 10A:
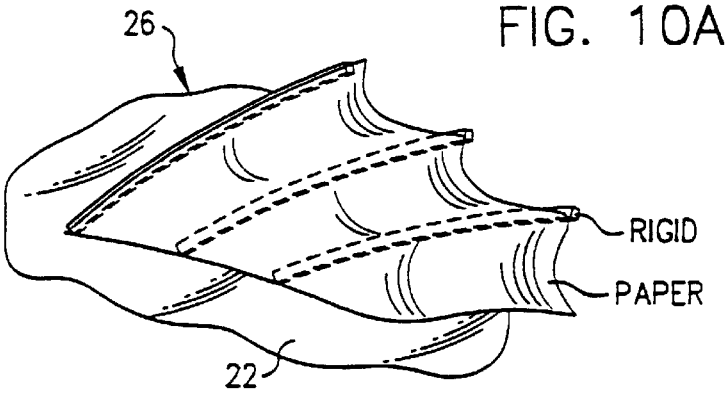
FIG. 10A is a detail perspective view of an alternative fin formed in accordance with the present invention.
Figure 10B:
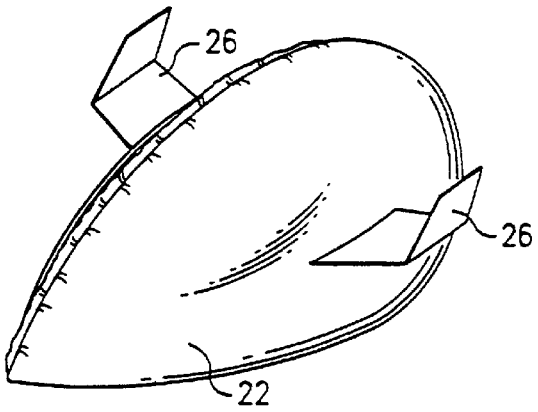
FIG. 10B and 10C are perspective views of other alternative fins formed in accordance with the present invention.
Figure 10C:
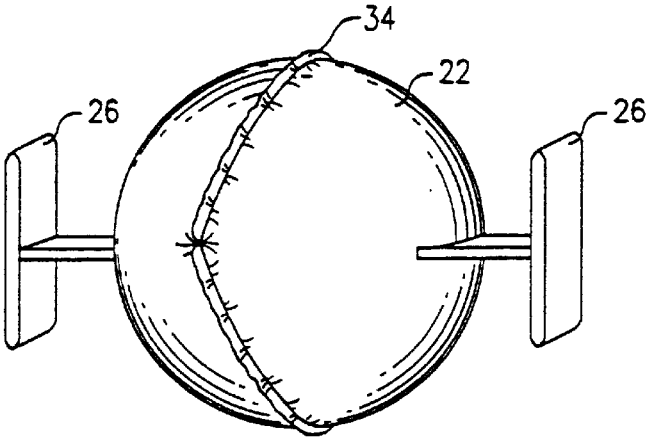

The precise number of fins 26 used may vary. It is important to the present invention that the number of fins be sufficient to provide both linear and angular stability in all dimensions. To accomplish this, the preferred plurality of fins 26 includes three or more individual fins. However, various single and double fin arrangements have been discovered to work acceptably. A single cylindrical fin, as shown in FIGS. 2E and 2F, are examples. The multi-surfaced dual fins of FIGS. 10B and 10C are acceptable alternatives. Optimum stability is achieved when the fins are arranged equi-distanced around the circumference of the body 22.

The placement of the fins 26 may depend on the number of panels used to create the body. The fewer the number of panels, the greater the transverse seam folds 54 at the connections of the panels. These folds 54 make it difficult to securely attach fins to the body. It is recommended that the fins 26 be attached to the outer body surface at locations not containing any folds 54. In general, the fins 26 may be attached using any one of a number of lightweight means, including ordinary tape, double-back tape, rigid plastic L-shaped brackets adhered to the fin and the body surface, etc.

The material used for the fins 26 should be light in weight. It has been found that extruded foam yields good results. Wood, paper, and plastic may all be used. In an alternative embodiment shown in FIG. 10A, the fins 26 are formed of thin plastic 51 stretched over a lightweight plastic frame 53.

What is important to the present invention is that the fins 26 are lightweight and include at least a few fins in aft half of the body surface. It is important that the fins 26 are outwardly oriented, with the most desirable orientation being radially outward. It has been found from experimentation that these requirements help balance the blimp, both during flight and while stationary. Such placement of fins 26 stabilizes the blimp's forward motion, and if attached symmetrically between sides, will keep the blimp from inadvertently turning in flight. A small angle of attack in the fin's placement can provide additional lift.

In an alternate embodiment, the fins 26 are rigid, though capable of being slightly deformed. Deforming the fins 26 allows them to be purposefully angled to cause the blimp 20 to propel itself in various patterns. For example, upper and lower fins bent to the left will cause the toy to propel in a horizontal, perpetually left-turning pattern. Another example, is to bend the trailing edge of the side aft fins severely upward to cause the toy to propel in a "loop-de-loop" manner. Deformable fins can provide many hours of amusement.

The propulsion system 28 (shown in FIGS. 11A–11C) includes a forward support 56, an aft support 58, an elongate shaft 60, a propeller 62, a propeller attachment member 64, a rubberband 66, and forward and aft hooks 68, 70. The propulsion system 28 is attached to the body 22 on an underside forward location via the forward and aft supports 56, 58.

Figure 11A:
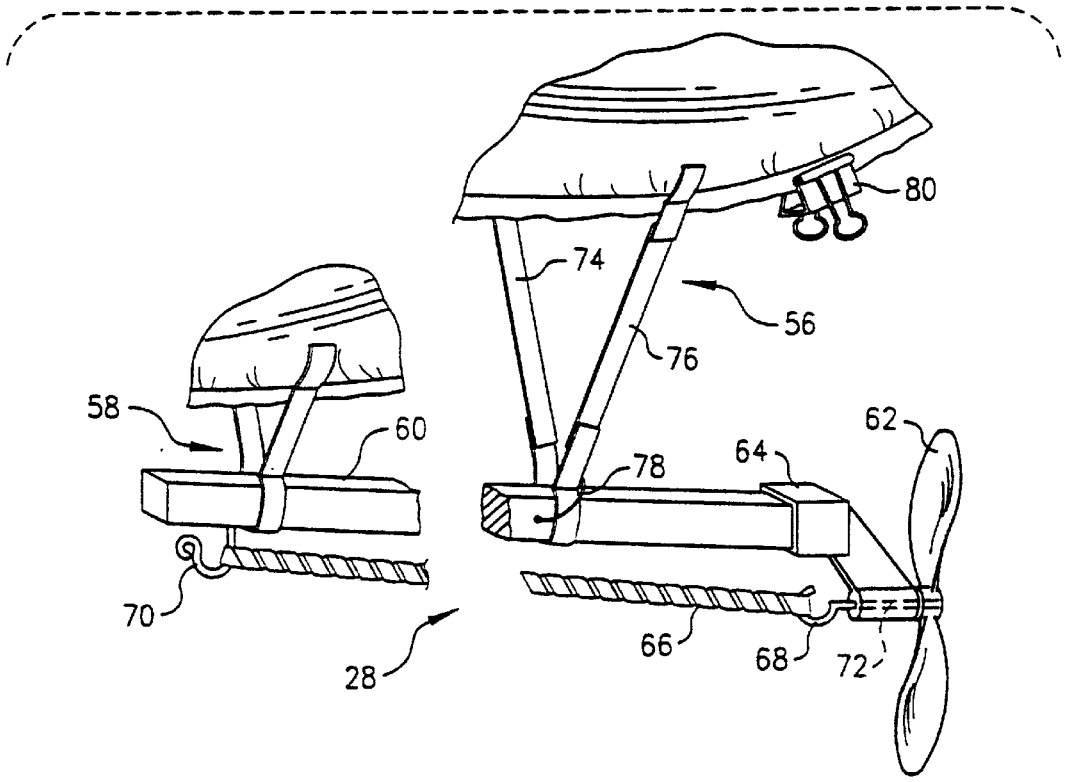
FIGS. 11A–11C are detail perspective views of alternative propulsion systems formed in accordance with the present invention, with some portions cut away for illustative purposes.

Referring to FIG. 11A, the forward and aft supports 56, 58 are thin strips of wood, plastic, foam, etc., each in the form of a V-shaped strut having first and second members 74, 76. Upper ends of the first and second members 74, 76 attach to the body 22. Lower ends of the first and second members 74, 76 attach to the elongate shaft 60. The first member 74 is located on one side of the body 22; the second member 76 is located on the other side of the body 22. This arrangement provides significantly more stability than simply using a single beam for the supports 56, 58. The preferred forward support 56 is longer than the aft support 58 so that the general orientation of the shaft 60 will be at a slight downward angle at its front end. The forward support 56 is attached to sites located in the lower forward half of the body 22, and the aft support 58 is attached to sites located in the lower body 22, aft of the forward support 56.

Still referring to FIG. 11A the forward support 56, the aft support 58, and the fins 26 may each be attached to the body 22 using a number of different methods. The most economical and efficient means is to simply tape, or glue, an end or edge directly to the body surface. Additional methods include small lightweight brackets, double-back tape, radio frequency welding, etc. The connection of the forward and aft supports 56, 58 to the elongate shaft 60 may be accomplished using one of a variety of methods. It is recommended, however, that a wire 78 be wrapped between each support 56, 58 and the shaft 60 in order to make the overall propulsion system 28 more durable.

The elongate shaft 60 is connected to both the forward and aft supports 56, 58 such that it lies in a longitudinal orientation relative to the body 22. The preferred shaft materials are wood, lightweight plastic, or semi-rigid foam. Composites, glass, carbon, kevlar, epoxy, polyester, stamped metal, etc. may be used, however, these materials are more expensive to make and offer no appreciable performance benefit. The shaft 60 may be configured to mimic an actual steel beam or other large scale component shape. The length of the shaft 60 should be preferably roughly one-half the length of the body 22. Using a longer shaft will result in a longer rubberband being used and significantly further distance of travel during play. A shorter shaft results in a shorter flight. For example, a two and one-half foot embodiment having a ten inch shaft and a small forward placed weight 80 (described below) will fly a distance of roughly 70 ft.

The propeller 62 includes an axial shaft 72 having a forward end connected to the propeller 62 through the rotational axis of the propeller. The axial shaft 72 and propeller 62 rotate in union. The axial shaft 72 is supported by the propeller attachment member 64 which is attached to the forward end of the elongate shaft 60. The propeller attachment member 64 is a small, cap-shaped (preferably) plastic piece capable of securing the axial shaft 72 in a longitudinal orientation. The distal end of the axial shaft 72 is connected to (or formed in the shape of) the forward hook 68. Rotation of the propeller 62 causes rotation of the axial shaft 72 and, therefore, rotation of the forward hook 68. The propeller 62 may be one of a number of known propeller-like designs, e.g., a multi-blade propeller, an Auger style propeller, a multilayer, multi-blade propeller, etc.

Figure 11B:
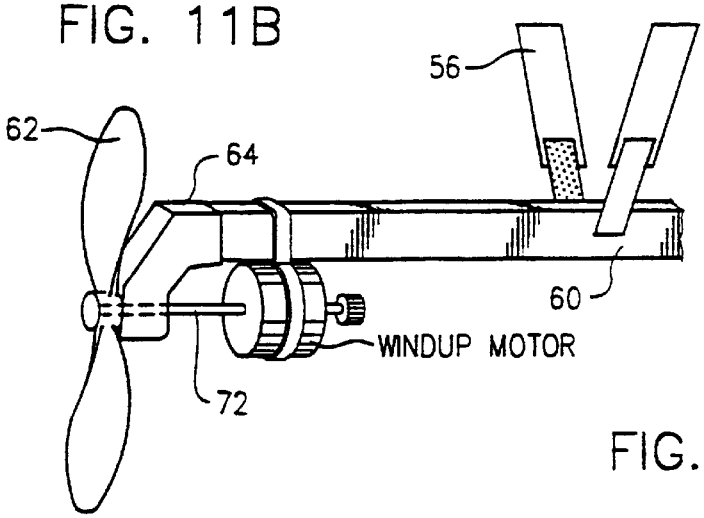
Figure 11C:
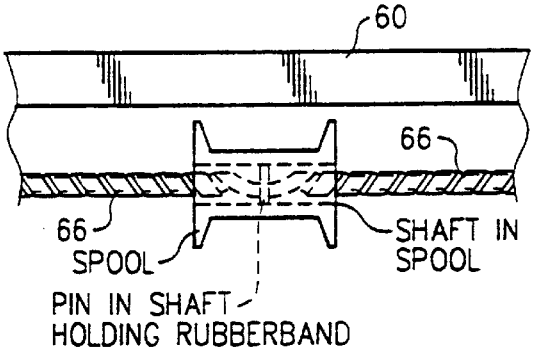

FIG. 11B shows an alternative propulsion system that uses a small windup spring loaded motor similar to those currently used in small toy cars, some bathtub toys, etc. FIGURE 11C shows an alternative propulsion system that uses a spool type rubberband motor, similar to those currently used in some toy snakes.

It has been found through experimentation and investigation, that the configuration of the propeller 62 at the forward end of the toy blimp 20 is both preferable and unique. Current crafts are designed to be lighter-than-air in both the stationary mode and in flight. The present invention is designed to be in equilibrium or lighter-than-air when the blimp is stationary, but heavier-than-air during flight. This is accomplished with the small weight clips 80, as described below. When the clips are attached, the present invention relies on the lifting gas to buoy most of the blimp's weight and the aerodynamic surface of the body to provide additional lift during propelled flight in order to maintain the blimp off the ground. As a result the toy blimp 20 will automatically return to earth after its rubberband power has been spent. While the rubberband 66 is unwinding, the present invention attains enough lift from its overall body shape and its fins 26 to fly. Because the toy blimp 20 will return to earth, there is no need for a control system of any kind. This means the gondola and the control system of conventional blimps are not needed, allowing the propulsion system 28 to be forwardly located and designed to counterbalance the weight of the fins 26 on the aft body surface. Current blimps are not capable of such an arrangement because they include a gondola that would interfere with the propeller airflow.

It has been found through experimentation that the elongate shaft 60 is best positioned with a forward downward angle of roughly 5 to 20 degrees. This has been found to have an aerodynamic benefit in moving the toy blimp 20 forward. It is believed that this is because the propeller airflow includes an aft component that pushes the toy blimp forward and an upward component that hits against the body surface causing an aerodynamic result similar to that which a occurs when a sailboat is sailing at an angle into the wind.

It is possible to orient the shaft 60 and propeller 62 in the opposite longitudinal orientation (i.e., the propeller is at the aft end of the elongate shaft), however, such an arrangement does not cause the best blimp flight performance. A third configuration of shaft and propeller orientations is possible, where the shaft is parallel to the longitudinal axis of the body and the forward and aft supports are substantially of the same length. This arrangement may be visually preferable for some embodiments, but results in sub-optimal flight performance as compared to the preferred angled-down configuration.

The forward and aft hooks 68, 70 are located on the underside of the forward and aft ends of the elongate shaft 60. The rubberband 66 is hooked between the forward and aft hooks 68, 70. The rubberband 66 should be of such a length as to be tautly kept between the hooks 68, 70, even when not wound. The forward hook 68 is connected to the axial shaft 72. The aft hook is attached directly to the aft end of the elongate shaft 60. Rotation of the propeller 62 about the attachment member 64 causes the forward hook 68 to rotate, further causing the rubberband 66 to twist and wind up. The reverse process happens during use, where the rubberband 66 unwinds and causes the forward hook 68, axial shaft 72 and propeller 62 to rotate, thus propelling the blimp 20.

In operation, the user then holds the toy blimp 20 via the elongate shaft 60 while turning the propeller 62 to cause the rubberband 66 to wind up. Once the rubberband 66 is sufficiently wound, the user points the blimp 20 away, in a slightly upward direction from horizontal. The user lets go of the propeller 62 and the elongate shaft 60 while gently pushing the blimp away. The potential energy in the wound rubberband 66 releases and causes the propeller 62 to rotate which further causes the blimp 20 to propel itself horizontally in the air. Once the propeller 62 and the rubberband 66 have spent their rotational energy, the blimp 20 will nose down slightly and return to earth.

Depending on the gas used to fill the body 22 of the toy, the blimp 20 may require one or more small weight clips 80 in order to urge the blimp 20 down at a faster rate. These are shown in FIGS. 1A and 11A If pure helium or hydrogen is used and no weights are added, then the toy 20 wit have a tendency to nose up during propelled flight and consequently move upward. After the rubberband 66 is spent, the blimp 20 will level off and remain at its altitude, or even drift higher. Of course, if the blimp 20 has flown high up, it may be difficult to retrieve. This is annoying and makes it very difficult to continue playing with the toy.

If one or more small weight clips are attached to the blimp 20 to make it heavier-than-air, then after the rubberband is spent, the blimp 20 will eventually come back to earth. When using 100% helium, it is desirable to place multiple small weight clips 80 on the blimp. If clips 80 are used that are not too heavy, then the blimp will fly appropriately and return to earth without taking too much time. Weight can also be added by using a mixture of air and helium. It has been found through experimentation, though, that the use of only air is not an alternative, because there is not enough available lift from the body surface during flight to overcome the weight of the air. As such, the toy will not fly.

The small weight clips 80 are to be included with the toy and not permanently attached thereto. This allows the user to add or remove the clips according to the gas used to fill the body 22, and to vary the clip locations according to desired results. This user interaction is considered an activity that increases the user's fun in playing with the toy. For the timid of heart, indicia are printed on the toy blimp indicating general locations upon which the clips may be placed in order to obtain maximum propelled flight and return to earth results.

Once the body 22 appears to be losing gas, the user may blow, or pump, breath into the body 22 or may go to a place where helium is sold (i.e., a flower shop, drug store, supermarket, hobby store, gift shop, card shop, etc.) and have the body 22 refilled with helium. It has been found that a body fully inflated with helium will remain taut for roughly five days, and that breath may be used to supplement the gas for an additional 2 ½ weeks. This provides roughly three weeks of enjoyment in playing with the toy blimp. When the toy blimp needs to be completely emptied and refilled, or stored, the valve 30 is opened and a soft structure, such as a thick blanket, is placed on top of the toy for roughly one hour. This will expel all gas from the body, making it very flat.

The toy may be used inside a building since it is slow enough to avoid damaging most household articles and sturdy enough to avoid destroying itself if it inadvertently contacts a wall or other obstruction. The toy can additionally be used outside, where the user will fully appreciate its graceful flight.

While the preferred embodiment of the invention has been illustrated and described, it will be apparent that various changes can be made therein without departing from the spirit and scope of the invention.

The embodiments of the invention in which an exclusive property or privilege is claimed are defined as follow:

1. A toy blimp comprising:

A gas-fillable envelope formed of an inelastic material that does not need to expand in order to contain enough gas to enable the toy to fly, at least two sheets of said inelastic material are sealed together adjacent their perimeters forming an outwardly extending flange, said flange providing an attachment means for a propulsion system, a) the gas-fillable envelope having an exterior surface, a lower portion, a fore end, an aft end;

b) at least one fin attached to the envelope exterior surface; and c) the propulsion system having a shaft and a propeller is attached to the envelope flange and to the envelope in a longitudinal orientation with respect to the envelope.

2. The toy blimp according to claim 1, wherein the envelope is fillable with helium.

3. The toy blimp according to claim 1, further comprising a one-way refill valve located in the envelope lower portion.

4. The toy blimp according to claim 3, wherein the one-way refill valve comprises an annular base attached to the envelope, a tubular nipple attached normally to the base and having an air passage, and a cylindrical stop having one end sized to fit within the nipple; wherein the envelope includes a cut at the location of the base that forms a flap over the air passage.

5. The toy blimp according to claim 1, wherein at least one fin includes at least three spaced apart fins attached around the circumference of the envelope and extending radially outward in a longitudinal orientation.

6. The toy blimp according to claim 1, wherein the at least one fin is formed of a material selected from the group comprising extruded foam, wood, plastic, and paper.

7. The toy blimp according to claim 1, wherein the at least one fin is rigid and capable of being slightly deformed.

8. The toy blimp according to claim 1, wherein the propulsion system comprises a rubberband for turning a propeller that is supported by the shaft; and at least one support connecting the shaft to the envelope and to the shaft.

9. The toy blimp according to claim 1, wherein the shaft is angled downward between about 5 to 20 degrees.

10. The toy blimp according to claim 9, wherein a length of the shaft is about one-half the longitudinal length of the envelope.

11. The toy blimp according to claim 1, wherein the propulsion system includes a small wind-up spring-loaded motor.

12. The toy blimp according to claim 1, wherein the propulsion system includes a spool-type rubberband motor.

13. The toy blimp according to claim 1, further comprises one or more weight clips detachable to one of the envelop and propulsion system.

14. The toy blimp according to claim 1, wherein the propeller is forward of or at the forward quarter of the longitudinal length of the toy.

* * * * *